United States Patent [19]

Robinson

[11] 4,131,895

[45] Dec. 26, 1978

[54] APPARATUS FOR ISOLATING FROM GROUND AND EXCITING A CONDUCTIVE TOWER FOR USE AS A VERTICAL ANTENNA

[76] Inventor: Ralph O. Robinson, 10206 Julep Ct., Silver Spring, Md. 20902

[21] Appl. No.: 723,110

[22] Filed: Sep. 14, 1976

[51] Int. Cl.[2] ..... H01Q 9/34

[52] U.S. Cl. ..... 343/792; 343/861; 343/874; 343/885

[58] Field of Search ..... 343/768, 791, 792, 890, 343/891, 874, 875, 884, 885, 861

[56] References Cited

U.S. PATENT DOCUMENTS

| | | | |
|---|---|---|---|
| 2,171,256 | 8/1939 | Moullin | 343/874 |
| 2,323,641 | 7/1943 | Bailey | 343/791 |
| 2,513,336 | 7/1950 | Lewis | 343/792 |
| 2,527,609 | 10/1950 | Willoughby | 343/874 |
| 2,750,589 | 6/1956 | Harris | 343/791 |
| 2,945,231 | 7/1960 | Scheldorf | 343/874 |
| 3,365,721 | 1/1968 | Bittner | 343/708 |

FOREIGN PATENT DOCUMENTS

| | | | |
|---|---|---|---|
| 1182113 | 1/1959 | France | 343/874 |

*Primary Examiner*—Eli Lieberman
*Attorney, Agent, or Firm*—Walter G. Finch

[57] ABSTRACT

A method and preferred apparatus for introducing radio frequency isolation near the base of a conductive tower to prevent significant flow of RF current into the ground, thereby to produce an elevated vertical antenna. The invention further relates to a method and apparatus for introducing RF power into the upper portion of the isolated tower to cause said portion to radiate or receive at desired frequencies. Isolation and "excitation" are accomplished by the placement of tuned shortened quarter wave conductive sections along selected portions of the tower, the quarter wave sections used for antenna excitation being also used for impedance transformation to match a coaxial transmission line of nominal inmpedance.

11 Claims, 4 Drawing Figures

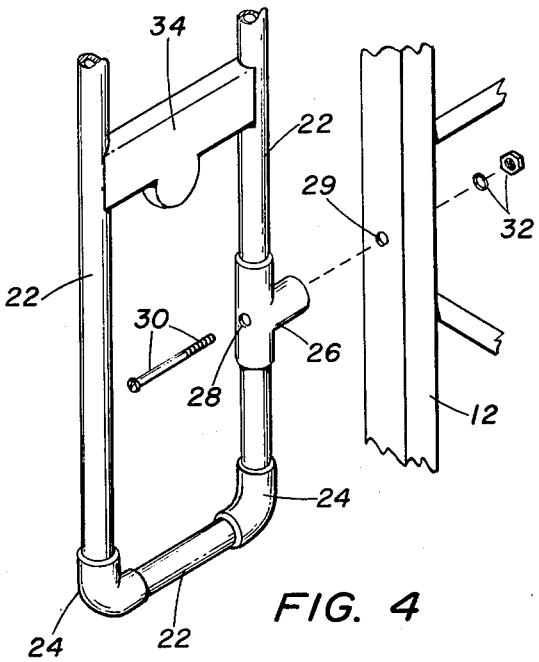
FIG. 4
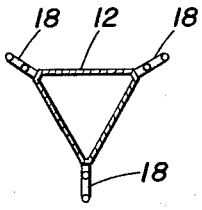
FIG. 2
FIG. 3
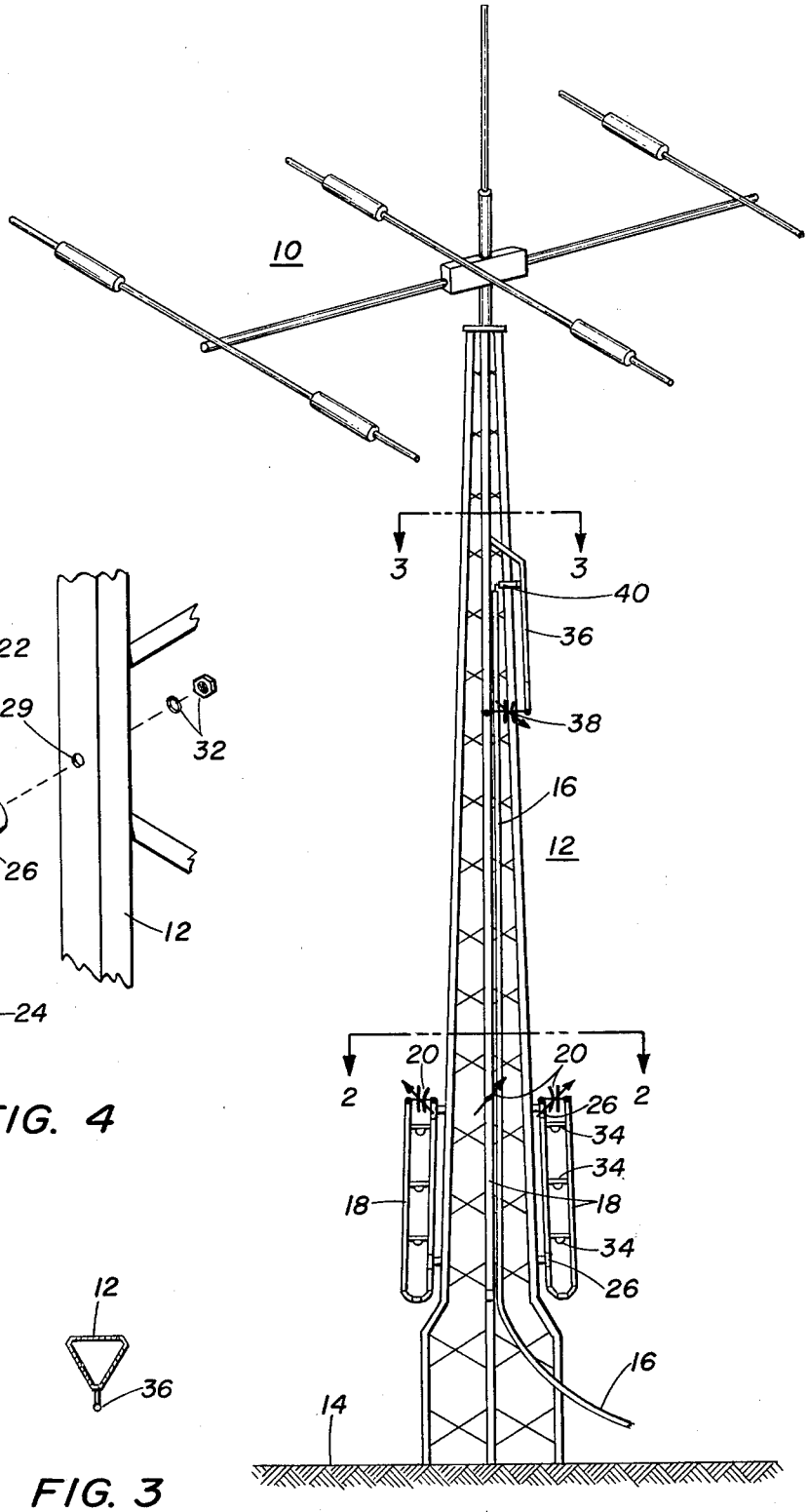
FIG. 1

APPARATUS FOR ISOLATING FROM GROUND AND EXCITING A CONDUCTIVE TOWER FOR USE AS A VERTICAL ANTENNA

BACKGROUND AND SUMMARY OF THE INVENTION

Vertical antennas must usually be operated above a ground plane which is either natural, man-made, or both, particularly where low frequency operation is desired. In such situations, the vertical antenna is either isolated from the earth by a base insulator or is connected directly to the earth and "shunt fed" by a "gamma match" or the equivalent thereof. In either situation, dipole radiation is accomplished through an "image" created by the ground plane at the base of the antenna. Typically, fifty or more conductive wires are buried in the earth a few inches below the surface thereof and extend radially outward from the base of the antenna for a distance of three-tenths of a wavelength or more in all directions. Thus, for low frequency transmission, installation of a ground radial system requires more "real estate" then is available to many who would like to benefit from the lower takeoff angles (less power) which a vertical antenna provides for long distance transmission. Further, the cost of installing such a ground radial system is substantial.

Antennas of varying effectiveness have previously been employed to circumvent the ground radial problem encountered with vertical antennas. Dipole antennas such as the well-known inverted "V" provide an essentially "horizontal" antenna with some vertical characteristics. Such antennas are unsightly and, while not requiring radials, take up a substantial amount of space above ground. The urban radio operator is thus still faced with problems of installation which cannot be reasonably solved by prior art antennas if adequate performance is to be achieved.

Antennas having a vertical orientation but without a ground radial system do exist. These antennas are "effectively" elevated above the ground, i.e., they radiate independently of the ground, and are associated with wavelengths of ten meters or less. Such antennas usually employ a pair of elements, i.e., dipoles, each a quarter wavelength long with the lower half of the dipole being electrically isolated from the vertical support structure. Such an arrangement requires structural isolation of the radiating portion of the vertical support structure, such as by a non-conductive structural section located between the ground and the radiating portion of the antenna.

According to the present invention, operation on wavelengths of 20 meters or greater can be accomplished by utilization of the metallic structure of the tower which is normally used simply to support other antennas. In effect, the metallic tower itself is caused to be an independent vertical antenna without the need for ground radial wires, without the need for insulating the tower itself from the ground, and without the need for base feeding the tower by the "shunt fed gamma match" system or its equivalent. Specifically, a conductive tower is isolated and caused to radiate from selected portions thereof so that radio signals can be transmitted or received in consideration of certain desirable conditions such as separation from RF absorptive or reflective objects, optimum electrical length, height above the ground, etc. The teachings of the present invention are also useful to restrict radiation from portions of the tower in order to prevent high RF absorption (power loss), RF radiation and excitation into other wires or circuits, and other undesirable effects which can be associated with the wide range of RF voltage and/or currents arising from the transmission of radio signals.

Although the invention is particularly useful for converting existing tower structures into vertical antennas for the lower frequency amateur radio bands the teachings of the invention are not restricted from use on any band or frequency. Considering the use of the invention in the amateur radio bands, a tower of the usual physical range of sizes can be used to support "yagi" or "quad" antenna for operating on the 10, 15, and 20 meter bands, and can also provide the capability for operating on the 40, 80, and 160 meter bands by combining the supporting tower and higher band antenna structures into a single element vertical antenna.

In order to effectively elevate a tower above ground so that an upper section can be excited, the upper portion of the tower must be isolated from the ground. According to the present invention, each conductive leg of a metal tower is fitted with a rectangular shaped inductor having a tunable condenser in the uppermost horizontal side of the inductor. The isolators which have a length which is effectively ¼ of a wavelength, are physically attached to the legs of the tower in a manner such that a conductive path is formed between the isolators and the tower. The isolators act to effectively elevate the upper portion of the tower above ground without the need for physically forming the lower portion of the tower from a non-conductive, structurally different material.

A tower can be made to radiate (or to receive) by excitation caused by a rectangularly shaped conductive member, or exciter, which works against the side of the tower, the exciter being tuned by a tunable condenser. The effective length of the exciter is one quarter wavelength, the tunable condenser and a standoff insulator being disposed at the lower end thereof. An RF ground connection is located at the upper end of the exciter while an RF feed point for a coaxial transmission line is located near the grounded end of the exciter.

Accordingly, it is an object of the invention to provide a method and preferred apparatus for isolating from ground and exciting a conductive tower for use as a vertical antenna.

It is a further object of the invention to enable the use of a metal tower normally utilized for structural support as a vertical antenna which does not require a ground radial system.

Further objects and advantages of the invention will become more apparent in light of the following description of the preferred embodiments.

BRIEF DESCRIPTION OF THE DRAWINGS

FIG. 1 is an elevation of a metal tower converted by the apparatus of the invention to use as a vertical antenna;

FIG. 2 is a section taken along line 2—2 of FIG. 1;

FIG. 3 is a section taken along line 3—3 of FIG. 1; and,

FIG. 4 is a detail perspective illustrating the connection of one of the tubular isolators to one leg of the tower.

DESCRIPTION OF THE PREFERRED EMBODIMENTS

Referring to FIG. 1, the present antenna 10 is seen to comprise a conductive tower 12 such as is commonly used for the support of relatively high frequency antennas including "yagi tribander" antenna and the like. According to the present invention, the tower 12 is caused to be isolated from the earth 14 without resort to a structurally dissimilar base portion. Upon isolation of the tower 12 from the earth 14, the tower can be made to radiate or receive along the most desirable section of its length. The tower 12 can be of the free-standing type such as the "Rohn Spaulding" tower. Isolation and excitation of the tower 12 are accomplished through the use of isolators 18 and exciter 36 respectively. Both the isolators 18 and exciter 36 are "tuned quarter wave sections" made from ordinary copper (or other conductive metal) tubing. One each of the isolators 18 are disposed on each leg of the tower 12 and act to reflect most of the RF energy back into said tower, thereby isoltaing the tower from the ground to produce a elevated vertical antenna. Excitation of the tower is achieved through the use of a tuned quarter wave section, i.e., the exciter 36, disposed at a selected location on the upper portion of the tower 12, the exciter 36 being fed by RF transmission lines 16 from the transmitter receiver.

The isolators 18 are essentially "shortened" quarter wave sections which represent a short circuit at one end and a high impedance at the opposite end to any RF currents of the frequency for which the isolators 18 are tuned. Thus, any current flowing down such a dipole meets with a high impedance and is reflected back in the opposite direction. The isolators 18 are effective quarter wave sections since the isolators are capacitively shortened by means of tuning condensers 20 located on the upper horizontal side portions of the rectangular isolators. Thus, the isolators 18 can be physically much shorter than a quarter wave in free space. The isolators 18 can be conveniently formed of ½ inch copper tubing 22, right angle bends 24, and T joints 26, such as are seen in FIG. 4. The T joints 26 have holes 28 formed therein which align with holes 29 in the tower legs. Bolts 30 and washer/nut assemblies 32 are conveniently used to attach the isolators 18 to the tower legs to form a conductive connection therebetween. The lengthwise side of the isolators 18 are preferably spaced apart by insulative spacers 34. As is seen in FIG. 2, one each of the isolators 18 are attached to each leg of the tower 12.

One each of the tuning condensers 20 resonates each of the isolators 18, the condensors 20 being typical 3-gang broadcast tuning condensors which have tuning ranges sufficient to tune the isolators 18 over the tuning range desired for the antenna 10. The tuning condenser 20 must be protected from the weather such as by inverted wide-mouth glass jars. The lines 16 feeding the tower 12 are disposed below the lower ends of the isolators 18. The tuning condenser 20 could take forms other than that described. For example, the combination of a vacuum variable in parallel with a feed vacuum condenser proves suitable for tuning the inductive isolators 18 to a specific band.

The portion of the tower 12 which lies above the isolators 18 can be excited by a shortened quarter wave section attached to the upper part of said tower 12 by means of a good electrical connection, the quarter wave section being known as the exciter 36. The exciter 36 is placed on the tower 12 near the current maximum of that portion of the tower which is caused to be an elevated dipole antenna through the action of the isolators 18. When RF currents are caused to circulate in the exciter 36 as would occur when driven by a transmitter, some of the currents are made to circulate in the antenna 10 itself since one side of the tuned quarter-wave exciter is in fact the center section of the antenna. The circulating RF currents excite that portion of the tower 12 which has been selected for excitation. Thus, the exciter 36 performs two functions. Firstly, the exciter 36 provides a means for introducing RF power into or for taking RF energy from that portion of the tower 12 which is caused to be the radiating portion thereof. Secondly, the exciter 36 provides a means for impedance transformation for both the resistive and the reactive terms needed for matching into a coaxial transmission line. With the exciter placed as shown in FIG. 1, the matching network thus produced does not feed any other transmission line feeding the antenna 10. The matching network is actually coincident with and part of the antenna itself. The exciter 36 is basically a high current device placed at a location to induce RF currents to flow to the point selected.

The exciter 36 as seen in FIGS. 1 and 3 to be attached to the tower at its upper end through a copper T joint and a 45 degree angle bend. The vertical copper portion of the exciter 36 is held away from the tower 12 at its lower end by means of a standoff insulator. A tuning condenser 38 is located between the tower 12 and the vertical copper portion of the exciter 36. The condenser 38 can conveniently be a vacuum variable condenser which requires the structural strengthening of the standoff insulator to prevent damage to the condenser. A coaxial transmission line is connected to the exciter 36 at a feed point 40 which is preferably near the upper grounded end of the exciter 40 in order to obtain a desired match.

From the foregoing it can be said that the isolators 18 essentially represent a lumped capacitor and inductance in a parallel resonant circuit, the circuit presenting a high impedance to any RF currents at the selected resonant frequency which might flow toward the ground end of the tower 12. In effect, the isolators 18 produce total reflection to all currents flowing down the tower 12. The present antenna 10 is thus effectively raised off the earth 14 by some distance which is a matter of choice dependent on factors such as location, tower height, etc. The exciter 36 is similarly a distributed inductance and a lumped capacity which effectively allows a tap into the lower end of a tuned quarter wave section in order to effect an impedance match. The present antenna 10 will, if in free space, have all of its RF charging currents due to top loading flow primarily into and out of the opposite leg of the dipole. Circulating currents related to top loading will flow through space to the opposite side of the dipole due to the high impedance presented by the isolators 18.

Although the invention has been disclosed as applied to a single antenna 10, obviously it is possible to provide a plurality of exciters 36, one tuned to each desired frequency and likewise a number of isolators 18 each tuned separately or connected in series, as preferred, to each of the various legs of a tower or supporting structure. The radiation pattern obtained from a multiple-element excited antenna may be treated in much the same manner as those of conventional multiple element arrays, with the difference that the major portion of the radiation emanates from the conducting regions of the tower and its appendages which are driven by the exciters 36 and isolated from each other in the same manner that the tower is isolated from the ground. As each section of an antenna has directional characteristics, which are slightly dependent upon its feed point, it is clear that a different pattern of electromagnetic field will result for different positions of the exciter 36. This property can be used to adjust and thus optimize the radiation pattern in the vertical plane. Varying vertical patterns are to be expected from each section of the antenna as the point of excitation is changed.

A number of antenna arrangements are possible, wherein two sections are excited by a transmitter to achieve greater gain or directional. For comparison, in a multiple exciter system, one of the exciters 36 would be assumed to be exciter 2 and the other exciter 1 having an exciter similar to exciter 1 in all respects and located symmetrically along the same vertical axis.

The transmitter would be connected to two phase-adjusting devices (not shown) and respectively, through its output coaxial cable. From the phasing device, a coaxial cable would proceed to an exciter 36 while, similarly from the phasing device, a second cable proceeds to the exciter 36 in the exciter section. Adjustment of the two phasing devices gives control of the relative phases of the excitations of the said two exciters. The phasing devices may be of any suitable types, and customarily include a variable reactance, such as a capacitor and/or inductance, and sometimes also a resistor, or a transmission line having distributed constants.

Obviously, many modifications and variations of the present invention are possible in the light of the above teachings. It is therefore to be understood that within the scope of the appended claims the invention may be practiced otherwise than as specifically described.

What is claimed is:

1. An antenna in the form of an elongated conductive supporting tower one end of which effectively joins to ground, said tower having isolator means including at least one tunable electrically shortened quarter wave length parallel transmission line section attached to at least one portion of the tower for providing a high impedance at said portion to current at the resonant frequancy thereof, the tower further having exciter means having at least one tunable electrically shortened quarter wavelength parallel transmission line section attached to at least a second portion of the tower for exciting said second portion to cause radiation or reception at a selected frequency, said isolator means and said exciter means both being substantially coincident with and parallel to said antenna.

2. The antenna of claim 1 wherein the conductive member is a tower and one of the sections is attached to each leg of the tower.

3. The antenna of claim 1 wherein each of the sections has a tunable condenser located thereon.

4. An antenna as recited in claim 1, wherein said exciter means is positioned substantially medially of said tower to achieve a dipole mode radiation.

5. An antenna as recited in claim 1, wherein said exciter means is positioned to achieve a desirable radiation angle.

6. An antenna as recited in claim 4, wherein one of the sections is attached to each leg of the tower.

7. An antenna as recited in claim 4, wherein each of the sections has a tunable condenser located thereon.

8. An antenna as recited in claim 5, wherein one of the sections is attached to each leg of the tower.

9. An antenna as recited in claim 5, wherein each of the sections has a tunable condenser located thereon.

10. An antenna as recited in claim 4, wherein one of the sections is attached to each leg of the tower, and each of the sections has a tunable condenser thereon.

11. An antenna as recited in claim 1, wherein the exciter means provides impedance match for resistive and reactive terms of the reflected impedance to give an effective resistive match into the transmission line section.

* * * * *